United States Patent [19]

Ernst

[11] Patent Number: 4,755,186

[45] Date of Patent: Jul. 5, 1988

[54] PROCESS FOR THE PREPARATION OF FISH SKIN

[75] Inventor: Rudolf Ernst, Santiago, Chile

[73] Assignee: Bernardo von Beck, Munich, Fed. Rep. of Germany

[21] Appl. No.: 909,842

[22] Filed: Sep. 19, 1986

[30] Foreign Application Priority Data

Sep. 26, 1985 [DE] Fed. Rep. of Germany ..... 3534353

[51] Int. Cl.[4] ..... C14C 1/00

[52] U.S. Cl. ..... 8/94.12

[58] Field of Search ..... 8/94.12, 94.13, 94.19, 8/94.32

[56] References Cited

U.S. PATENT DOCUMENTS

| | | | |
|---|---|---|---|
| 2,633,730 | 4/1953 | Rose | 8/94.12 |
| 2,700,590 | 1/1955 | Biery et al. | 8/94.12 |
| 4,224,029 | 9/1980 | Heinz | 8/94.19 R |
| 4,379,708 | 4/1983 | Rego | 8/94.12 |

FOREIGN PATENT DOCUMENTS

| | | | |
|---|---|---|---|
| 0007240 | of 1927 | Australia | 8/94.12 |

*Primary Examiner*—Paul Lieberman
*Assistant Examiner*—John F. McNally
*Attorney, Agent, or Firm*—Collard, Roe & Galgano

[57] ABSTRACT

A process for the preparation of fish skin consists in (a) descaling and at least partially degreasing of the skins in a bath containing one or more surface active anionic, non-ionic or amphoteric organic compounds in a small amount of water, (b) treating the skins in a second bath containing a keratolytic enzyme or an alkali metal sulphide and/or alkali metal hydrogen sulphide, lime and water under stirring and optionally further removing the sulphide by adding a precipitating agent for the sulphide and washing, (c) degreasing the skins simultaneously with step (b) or in a separate bath by means of surface active non-ionic and/or anionic compounds and/or solvents and/or enzymes, (d) pretanning the skins with an aromatic syntan at a temperature of below 20° C. and a pH of 5 to 8, (e) pickling the skins in an acid and salt containing pickling bath at a pH of 1.5 to 4 and (f) tanning the skins in a manner known per se with a chromium and/or syntan tanning solution and (g) optionally, after a resting period of several hours, washing and retanning the skins with chromium a aluminium salts and/or syntans and subsequently, if desired, dyeing and fat liquoring in a known manner, drying and further mechanical processing of the skins.

13 Claims, No Drawings

PROCESS FOR THE PREPARATION OF FISH SKIN

FIELD OF THE INVENTION

The invention concerns a process for the preparation of fish skin.

The preparation of leather orignating from animals comprises customarily the exposure of the inner or true skin, optionally pretanning followed by tanning and after-treating the leather comprising dyeing, fat-liquoring, drying and finishing as well as mechanical processing.

Although a highly developed technique for the preparation of leather from skins of mammals such as cows, pigs, sheep and goats exists the preparation of leather from fish skin has been neglected because of the difficulties arising from the special structure of the collagen of the inner skin with the exception of shark skin which has another structure. The process of the custumary pretreatment of the so-called fish skin pelt by preservation, drying, softening in a water bath, descaling and depilating, respectively by lime treatment i.e. decomposing of the keratin by means of calcium hydroxide and sodium sulphide, deliming and scouring as well as pickling in acid and salt containing liquors and tanning in rotating tanning drums containing tanning substances such as chromium salts or tanning substances of plant origin, further washing, fat liquoring, drying, optionally colouring and mechanical treatment (finishing) results usually in soft and limp leather or too rigid leather similar to the leather of reptile skin, but not leather that is simultaneously pliable, soft and of good strength to the touch.

BACKGROUND AND DISCUSSION OF PRIOR ART

It is known from U.S. Pat. No. 2,700,590 to use tanning agents having a high adstringent effect such as the combination of certain vegetable extracts and a condensation product of a phenol sulpho acid with formaldehyde for tanning the skins of teleosteans, sharks and mammals under special consideration of the easy hydrolysis of the fish collagen. This allows the tanning and thus preservation of skin but the leather becomes very rigid similar to reptile leather but without its pliability and softness. Further the descaling and the removal of the keratin and of other protein components of the skin is not mentioned which constitutes a major problem in the tanning of fish skin.

Further according to U.S. Pat. No. 4,379,708 fish skin tanning is carried out by adjusting the pH of the skin to 1.5 to 3.5 and tanning in two steps by using first a diluted liquor below 35° C. and finally a concentrated liquor at a temperature exceeding 35° C., followed by washing and fat liquoring and adjusting to a pH of at least 6, resulting a leather of a certain softness.

However a good tensile strength and a full feel as well as a pliability of the leather product as well as the necessary strength against the effects of the chemical adstringent during the process are not reached.

In French patent No. 729,942 a tanning method for fish skin is disclosed according to which syntans and subsequently vegetable tanning agents or a mixture of both are used followed by chromium tanning. By this method however, neither the softness nor the pliability of the leather is reached that is held to be desirable.

The process for tanning fish skin is quite different from the process of tanning mammalian skin because of the great difference in the molecular structure of the collagen of fish skin on one hand and of mammalian skin on the other hand. Fish collagen has a linear structure contrary to the branched structure of mammalian collagen. This explains the remarkable difference in the bonds which may be tanned with respect to strength against the temperatures of hydrolysis and the tensile strength.

Further there is an important difference between the temperatures of hydrolysis of the skins. With fish skin this value is about 20° C. lower for almost all fish species than that of mammalian skin. This means that all processes prior to tanning must be carried out at 20° C. below the temperature which is recommended for the pretreatment of mammalian skin.

DESCRIPTION OF THE PREFERRED EMBODIMENT

An object of the invention is a process which allows to produce soft and pliable leather from fish skin which is nonetheless of high strength.

Another object of the invention is a process which allows the processing of sensitive skin of fish species which may not be processed by other processes known in the art.

The process of the invention is characterized in that (a) fish skins are descaled and at least partially degreased in a bath containing one or more surface active anionic, non-ionic or amphoteric organic compounds in a small amount of water, (b) the skins are treated in a second bath containing a heratolytic enzyme or an alkali metal sulphide and/or an alkali metal hydrogen sulphide, lime and water under stirring and further optionally the sulphide is removed by adding a precipitating agent for the sulphide, (c) the skins are degreased either simultaneously in step (b) or in a separate bath by means of surface active non-ionic and/or anionic compounds and/or solvents and/or enzymes, (d) the skins are pretanned with an aromatic syntan at a temperature of below 20° C. and a pH of 5 to 8, (e) the skins are pickled in a bath containing acid and salt at a pH of 1.5 to 4 and (f) the skins are tanned in a manner known per se with a chromium and/or syntan tanning solution and (g) the skins are optionally washed and retanned with chromium or aluminium salts and/or syntans after a resting period of several hours, followed, if desired, by dyeing and fat liquoring in a known manner, drying and further mechanical processing of the skins.

According to a preferred embodiment of the invention in step (a) a condensation product of alkylene oxide with a $C_5$- to $C_{20}$-alkanol a higher fatty acid ester with a $C_5$- to $C_{20}$-alkanol or a fatty or fatty alcohol sulphonate or -sulphate is used as the surface active compound.

According to another preferred embodiment pretanning in step (d) is carried out with the condensation product of an aromatic mono-, di- or trisulphonic acid with formaldehyde. The preferred mono-, di- or trisulphonic acid is derived from phenol, naphthaline and/or lignin.

Whereas according to the invention use is made from chemicals and liquors known in the production of leather the inventive process steps are different in the order of the application and at least partially in the conditions of the process. It is surprising and by no means obvious that fish skin could be processed to give leather ready for any use with especially good properties.

EXAMPLE

The process of the invention was applied to tanning of the skin of the Sea-Bass which belongs to the family of Seranidae.

The amounts given refer to 1000 g of fresh or rewetted skins.

(a) The skins were treated in a drum containing 5 to 12 g of a condensation product of ethylene oxide with an $C_8$-$C_{12}$-alkanol mixture in 50 to 100 g of water for 15 to 60 min. Then the skins were washed by adding water until a bath ratio of 100 to 300% was reached.

(b) To the skins in the drum there were added 1000 to 3000 g of water, 3 to 5 g of sodium sulphide and 6 to 14 g of calcium hydroxyde in order to prepare the collagen for the tanning process. This bath was moved for 20 to 60 mins. Subsequently the skins were rinsed for at least 20 mins. with a large amount of water.

(c) To the rinsed skins 1000 to 2000 g of water were added as well as 15 to 30 g of an inorganic salt that reacts with the alkaline sulphur compound of the preceding step and forms an insoluble salt, such as calcium carbonate. Further 3 to 8 g of a soluble sodium salt of an organic acid, namely phenol sulphonic acid, were added and the bath was moved for 20 to 30 mins. until the chemicals used in step (b) were fully precipitated, after that the skins were rinsed with water for 15 mins.

(d) To the rinsed skins 1000 g of water and 5 to 15 g of a condensation product of formaldehyde with phenol or naphthaline which as able to react at a temperature below 19° C. and a pH of between 5 and 8 was added. This treatment was repeated for 15 to 45 min. under continous movement of the drum.

Subsequently 2000 g of water and 140 g of sodium chloride were added and the drum was further moved for 15 mins. Then 18 g of a preferably organic acid, namely formic acid, was added (another acid, such as an inorganic acid, would also be applicable) to reach a pH of 1.5 to 3.5. The bath was moved for further 120 to 180 mins.

(e) To the bath 25 to 40 g of tanning agent were added, preferably a chromium sulfate of a basicity of 33%. Alternate resting and moving periods up to a about 12 hours of total treatment were carried out. Although the bath can further be used for the following steps it was removed and the process carried out further with a new bath.

(f) A new bath for a common chromium tanning process with 9% chromium salt of 33% basicity was used which was basified in the usual manner. Then the skins were allowed to rest on trusses for 8 hours.

(g) The skins were retanned with a blend of two syntans, both being condensation products of formalin with different organic acids, namely a blend of glutaraldehyde and a condensate of naphthaline disulphonic acid with formaldehyde.

Subsequently the leather was finished by usual and fat liquoring and mechanical treatment.

The resulting leather had a certain similarity with reptile leather of about comparable strength but was pliable and flexible such as a fine leather for purses etc.

I claim:

1. A process for the preparation of leather from fish skin comprising the steps of:

(a) descaling the fish skins, prior to chemical modification, in a moving drum containing a first bath of at least one surface active member selected from the group consisting of anionic, non-ionic and amphoteric organic compounds and a combination thereof, said descaling preserving the scale pockets;

(b) treating the skins in a second bath containing a member selected from the group consisting of keratolytic enzyme, an alkali metal sulphide, an alkali metal hydrogen sulphide, lime and water and a combination thereof under stirring;

(c) degreasing the skins by means of the action of a surface active member selected from the group consisting of non-ionic compounds, anionic compounds, solvents and enzymes, and a combination thereof;

(d) pretanning the skins with a syntan at a temperature of below 20° C. and a pH of 5 to 8;

(e) pickling the skins in a bath containing acid and salt at a pH of 1.5 to 4; and (f) tanning the skins with a member selected from the group consisting of chromium tanning solutions, a syntan tanning solution and a combination thereof.

2. A process as claimed in claim 1, wherein said group of surface active members further consists of a condensation product of alkylene oxide with $C_5$- to $C_{20}$-alkanol, a fatty sulphonate alcohol, a fatty sulphonate, a fatty -sulphate and a fatty alcohol-sulphate and a combination thereof.

3. A process as claimed in claim 1, wherein the pretanning step is carried out with a member selected from a group consisting of a condensation product of a monosulphonic acid, disulphonic acid, trisulphonic acid and flormaldehyde and a combination thereof.

4. A process as claimed in claim 3, characterized in that the mono-, di- or trisulphonic acid is derived from a member selected from a group consisting of phenol, naphthaline and lignin and a combination thereof.

5. A process as claimed in claim 1, wherein the pretanning and tanning steps are carried out in the same bath.

6. A fish skin leather as prepared according to a process as claimed in claim 1.

7. A process as claimed in claim 1, further comprising the steps of:

resting the skins after tanning; and then washing and retanning the skins with a member selected from the group consisting of aluminium salts, chromium salts and syntans and a combination thereof.

8. A process as claimed in claim 7, further comprising the steps of:

liquoring the skins with fat after retanning;

dyeing the skins after said liquoring; and the mechanically processing the skins.

9. A process as claimed in claim 1, further comprising:

immediately after treating said skins with said alkali metal sulphide, removing any sulphide remaining from the treatment in said second bath by adding a precipitating agent and washing the skins.

10. A process as claimed in claim 1, wherein said degreasing step takes place in said second bath.

11. A process as claimed in claim 1, wherein said fish skins are descaled in said first bath for 15 to 60 minutes, treated in said second bath for 20 to 60 minutes, and wherein said degreasing step takes place for 20 to 30 minutes, and said pretanning step for 15 to 45 minutes and said pickeling step for 135 to 195 minutes.

12. A process as claimed in claim 1, wherein said degreasing step takes place in a separate bath.

13. A process as claimed in claim 1, further including the step of at least partially degreasing said fish skins in said first bath simultaneously with said descaling.

* * * * *